US006487825B1

(12) United States Patent
Sillik

(10) Patent No.: US 6,487,825 B1
(45) Date of Patent: Dec. 3, 2002

(54) HOLDER FOR INSULATION

(76) Inventor: Francisco J. Sillik, 6410 Calle Bellatrix, Tucson, AZ (US) 85710

( * ) Notice: Subject to any disclaimer, the term of this patent is extended or adjusted under 35 U.S.C. 154(b) by 0 days.

(21) Appl. No.: 09/351,444

(22) Filed: Jul. 12, 1999

(51) Int. Cl.[7] ..... E04B 1/74

(52) U.S. Cl. ..... 52/404.1; 52/222; 52/406.1; 52/712; 248/343

(58) Field of Search ..... 52/404.1, 406.1, 52/222, 712; 248/58, 343, 217.2; 411/520, 529

(56) References Cited

U.S. PATENT DOCUMENTS

| | | | | | |
|---|---|---|---|---|---|
| 796,178 | A | * | 8/1905 | Beaton | 248/217.2 X |
| 892,145 | A | * | 6/1908 | Ferres | 248/217.2 X |
| 1,289,368 | A | * | 12/1918 | Berg | 248/217.2 X |
| 2,191,804 | A | * | 2/1940 | O'Malley | 72/40 |
| 2,239,394 | A | * | 4/1941 | MacKechnie | 20/4 |
| 2,917,263 | A | * | 12/1959 | Appleton et al. | 248/217.3 |
| 3,162,413 | A | * | 12/1964 | Hexdall | 248/217.2 X |
| 3,163,386 | A | * | 12/1964 | Collins | 248/217.2 X |
| 3,245,677 | A | * | 4/1966 | Hurd et al. | 248/217.2 X |
| 3,355,203 | A | * | 11/1967 | Stauffer | 287/189.35 |
| 3,553,347 | A | * | 1/1971 | Harding | 174/84 |
| 3,609,933 | A | * | 10/1971 | Jahn et al. | 52/464 X |
| 4,023,323 | A | * | 5/1977 | Fortin | 52/712 |
| 4,043,092 | A | * | 8/1977 | Paul et al. | 52/712 |
| 4,292,783 | A | * | 10/1981 | Mulvihill | 52/741 |
| 4,379,381 | A | * | 4/1983 | Holcombe | 52/404 |
| 4,437,282 | A | * | 3/1984 | O'Brien | 52/407 |
| 4,476,659 | A | * | 10/1984 | Player | 52/404 |
| 4,512,130 | A | * | 4/1985 | Pepin | 52/404 |
| 4,545,166 | A | * | 10/1985 | Kielmeyer | 52/484 |
| 4,573,298 | A | * | 3/1986 | Harkins | 52/404 |
| 4,590,727 | A | * | 5/1986 | Ghahremani et al. | 52/406 |
| 4,756,134 | A | * | 7/1988 | Murphy | 52/404 |
| 4,799,347 | A | * | 1/1989 | Byler | 52/712 |
| 4,875,320 | A | * | 10/1989 | Sparkes | 52/406 |
| 5,095,673 | A | * | 3/1992 | Ward | 52/404 |
| 5,245,811 | A | * | 9/1993 | Knorr | 52/481 |
| 5,359,823 | A | * | 11/1994 | Kidaloski et al. | 52/506.01 |
| 5,667,181 | A | * | 9/1997 | Van Leeuwen et al. | 248/343 |
| 5,809,709 | A | * | 9/1998 | Ryan et al. | 52/222 |
| 6,062,515 | A | * | 5/2000 | Snyder | 248/217.2 X |
| D442,063 | S | * | 5/2001 | Snyder | D8/349 |

FOREIGN PATENT DOCUMENTS

| | | | | |
|---|---|---|---|---|
| DE | 3106299 | * | 2/1981 | 248/217.2 |

* cited by examiner

*Primary Examiner*—Bruce A. Lev
(74) *Attorney, Agent, or Firm*—Antonio R. Durando

(57) ABSTRACT

A holder for supporting insulation in a building has an elongated supporting section for the insulation to rest on. Two arms extend in parallel from the two ends of the supporting section, and each arm carries a U-shaped member which can be pushed onto a stud or beam by elastically spreading apart the legs of the U-shaped member. Each U-shaped member is provided with at least one hook-like portion which is elastically urged onto the respective stud or beam to anchor the holder thereto.

17 Claims, 5 Drawing Sheets

HOLDER FOR INSULATION

BACKGROUND OF THE INVENTION

1. Field of the Invention

The invention relates to the insulation of structures.

2. Description of the Prior Art

Insulation installed underneath a roof is typically placed between two studs or beams. The insulation is prevented from falling by wire hangers which extend from one stud to the other and are anchored in the studs.

The ends of the hangers are pointed, and the hangers are anchored in the studs by hammering. This is time-consuming since the number of hangers is large.

SUMMARY OF THE INVENTION

It is an object of the invention to reduce the installation time for insulation.

The preceding object, as well as others which will become apparent as the description proceeds, are achieved by the invention.

One aspect of the invention resides in an article for holding insulation. The article comprises a holder having a first element for supporting insulation and a self-anchoring second element for anchoring the holder to a structure to be insulated.

The self-anchoring element of the holding article according to the invention permits the article to be anchored to a structure without hammering. This makes it possible to reduce the time for fixing insulation in place.

Another aspect of the invention resides in a structure having an interior and a plurality of structural components at least in part bounding the interior. The structure further has insulation adjacent to at least one of the structural components, and at least one holder for the insulation. The holder includes a first element which supports the insulation and a self-anchoring second element which anchors the holder to a selected structural component.

An additional aspect of the invention resides in an insulating method. The method comprises the steps of placing insulation adjacent to a structure, and confining the insulation between the structure and a holder. The confining step includes self-anchoring of the holder to the structure.

The method can further comprise the step of adjusting the length of the holder prior to the confining step. The confining step may involve gripping the structure with the holder.

Additional features and advantages of the invention will be forthcoming from the following detailed description of preferred embodiments when read in conjunction with the accompanying drawings.

DESCRIPTION OF THE PREFERRED EMBODIMENTS

Figure 1:
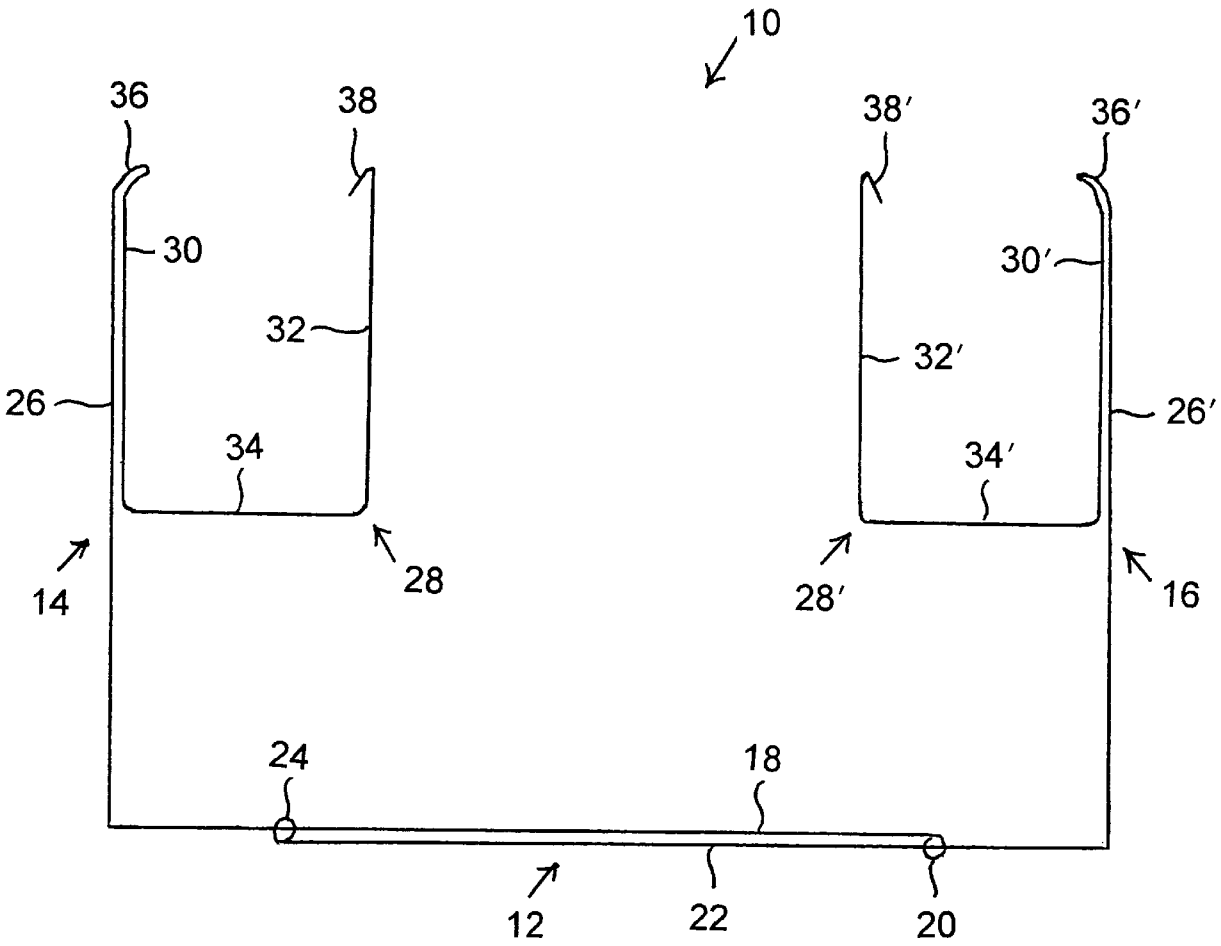
FIG. 1 is an elevational view of an article in accordance with the invention for holding insulation.

Referring to FIG. 1, the numeral 10 identifies an article in accordance with the invention for holding or confining insulation. The holding article 10 includes a supporting element 12 which functions to support insulation. The supporting element 12 is elongated and has spaced longitudinal ends, and an anchoring element 14 is secured to one of the ends while another anchoring element 16 is secured to the other of the ends. The anchoring elements 14,16 serve to anchor or fix the article 10 to a structure being insulated.

The supporting element 12 comprises a supporting arm or section 18 having an end which coincides with the end of the supporting element 12 affixed to the anchoring element 14. The supporting arm 18 has a second end which is normally located between the two ends of the supporting element 12, and this end of the supporting arm 18 is formed with a loop or guiding portion 20.

The supporting element 12 further comprises a second supporting arm or section 22 having an end which coincides with the end of the supporting element 12 affixed to the anchoring element 16. The supporting arm 22 has another end which is normally located between the two ends of the supporting element 12, and this end of the supporting arm 22 is formed with a loop or guiding portion 24.

The supporting arm 18 passes through the loop 24 of the supporting arm 22. Similarly, the supporting arm 22 passes through the loop 20 of the supporting arm 18. The supporting arms 18, 22 pass through the respective loops 24,20 with clearance so that the supporting arm 18 and the supporting arm 22 can move longitudinally relative to one another. This enables the length of the supporting element 12 to be varied. By varying the length of the supporting element 12, it becomes possible to adjust the holding article 10 to different structural conditions, e.g., to different distances between the studs or beams of a structure.

The loop 20 of the supporting arm 18 is located between the loop 24 of the supporting arm 22 and the end of the supporting arm 18 remote from the loop 20. Likewise, the loop 24 of the supporting arm 22 is located between the loop 20 of the supporting arm 18 and the end of the supporting arm 22 remote from the loop 24. The loops 20,24 are designed so that the loop 20 is unable to pass through the loop 24 and the loop 24 is unable to pass through the loop 20. This arrangement prevents separation of the supporting arms 18,22 from one another.

The anchoring element 14 comprises an arm 26 having an end which is fast with the end of the supporting arm 18 remote from the loop 20. The anchoring arm 26 is normal to the supporting arm 18, and the arms 18,26 together define an L-shaped part of the holding article 10. In the illustrated embodiment, the supporting arm 18 and the anchoring arm 26 are integral, and the L-shaped part of the holding article is formed by bending the material of the holding article The anchoring arm 26 carries a generally U-shaped anchoring member 28 which, in the present case, is integral with the anchoring arm 26 and is produced by bending the material of the anchoring element 14. The U-shaped member 28, which is here suspended from the end of the anchoring arm 26 remote from the supporting arm 18, is located on the same side of the anchoring arm 26 as the anchoring element 16.

The U-shaped member 28 includes a pair of legs 30 and 32 which are generally parallel to each other and to the anchoring arm 26. At the ends of the legs 30,32 nearest the supporting arm 18, the U-shaped member 28 is closed by a crosspiece 34 connecting the legs 30,32 to one another. The U-shaped member 28 is open at the opposite ends of the legs 30,32.

The leg 30 of the U-shaped member 28 is located between the anchoring arm 26 and the leg 32 of the U-shaped member 28. The end of the leg 30 remote from the supporting arm 18 is inclined upward and towards the leg 32 as considered in a direction away from the supporting arm 18. The end of the anchoring arm 26 remote from the supporting arm 18 is similarly inclined, and these two ends are joined to one another to form a claw-like gripping portion 36 of the anchoring element 14.

The leg 32 of the U-shaped member 28 is situated between the leg 30 and the anchoring element 16. The end of the leg 32 remote from the supporting arm 18 is inclined downward and towards the leg 30 as considered in a direction towards the supporting arm 18. Accordingly, a hook-like anchoring portion 38 of the anchoring element 14 is produced at this end of the leg 32. The anchoring portion 38 is located at the same distance, or at approximately the same distance, from the supporting arm 18 as the gripping portion 36.

The U-shaped member 28 is designed to receive and grip a stud or beam of a structure to be insulated. The construction of the U-shaped member 28 is such that the U-shaped member 28 can be readily slipped onto a stud or beam. Thus, the gripping portion 36 and the anchoring portion 38 are shaped to slide easily when the U-shaped member 28 is pushed over a stud or beam. However, when the U-shaped member 28 is subjected to a force which acts to slide the U-shaped member 28 off the stud or beam, the anchoring portion 38 attempts to dig into the stud or beam. The anchoring portion 38 then functions as an anchor to hold the U-shaped member 28 on the stud or beam.

The U-shaped member 28 is preferably designed so that the legs 30,32 are spread apart elastically when the U-shaped member 28 is pushed onto a stud or beam. Under such circumstances, the legs 30,32 are urged towards each other after the U-shaped member 28 has been slipped onto the stud or beam thereby increasing the grip of the legs 30,32 on the stud or beam.

If the holding article 10 is to be used for the support of an insulating batt, the length of the anchoring arm 26 is advantageously selected in such a manner that the batt is not compressed, or is compressed very little, when held in place by the holding article 10. This allows essentially the full insulating value of the batt to be realized.

The anchoring element 16 is mirror-symmetrical to the anchoring element 14 about a plane midway between the anchoring elements 14,16 and normal to the supporting element 12. Accordingly, the anchoring element 16 will not be described. The same reference numerals as for the anchoring element 14, but with primes, denote corresponding parts of the anchoring element 16.

The anchoring elements 14,16 are self-anchoring elements. Thus, the anchoring elements 14,16 are capable of gripping a stud or beam without being forced against or into the stud or beam by external forces.

The material for the holding article 10 should be capable of retaining a shape and should be able to absorb the forces applied by insulation held in place by the article 10. Furthermore, it is preferred for the material to exhibit at least some elasticity so that the legs 30,32 of the U-shaped member 28 and the legs 30',32' of the U-shaped member 28' are resiliently urged towards one another when spread apart by a stud or beam. By way of example, the holding article 10 can be made from steel wire or rod.

Figure 2:
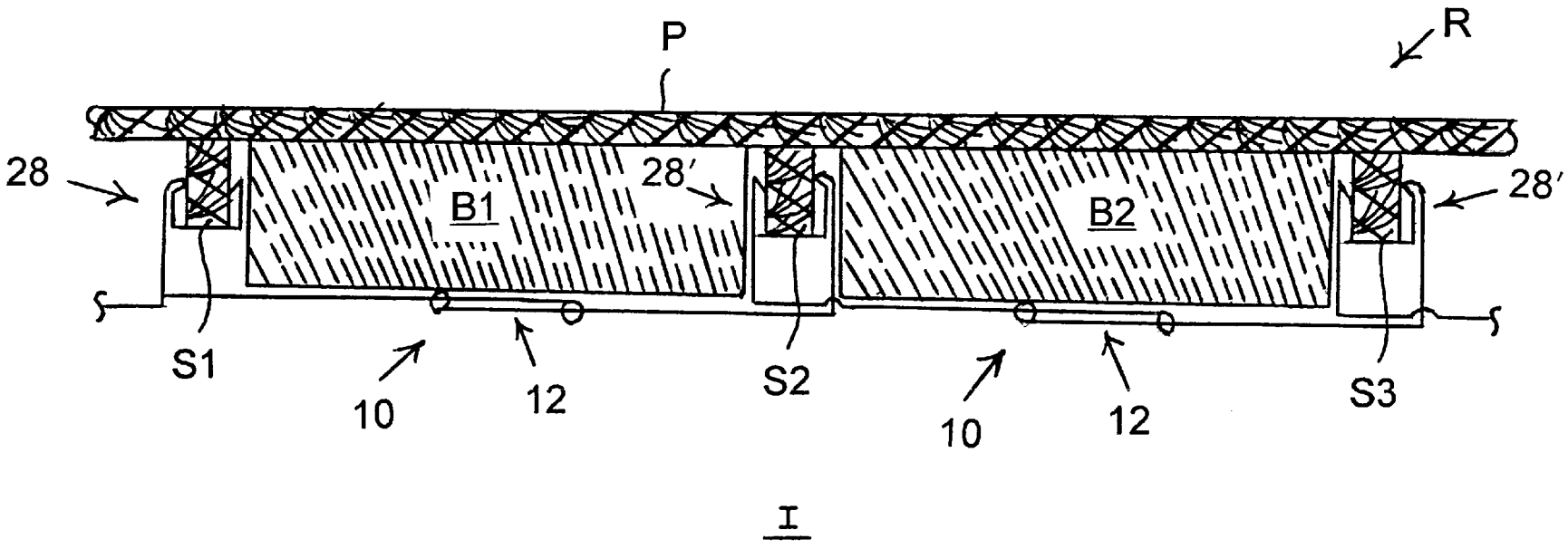
FIG. 2 is a schematic sectional view of the roof of a structure with insulation held in place by holding articles designed as in FIG. 1.

FIG. 2 schematically illustrates a building or structure having an interior I covered by a roof R. The roof R is made up of several structural components including one or more sheets of plywood P, and a series of studs or beams mounted on the underside of the plywood P, i.e., the side of the plywood P facing the interior I. Three of the studs or beams are shown and are identified by S1, S2 and S3, respectively.

An insulating batt B1 lies against the underside of the plywood P between the studs S1 and S2. The batt B1 is held in place by one or more of the holding articles 10 of the invention. A holding article 10 for the batt B1 is visible in FIG. 2 where it can be seen that the U-shaped member 28 grips the stud S1 while the U-shaped member 28' grips the stud S2.

The underside of the batt B1 sits on the supporting element 12 of the holding article 10. The batt B1 has a predetermined thickness in undeformed condition thereof, and the distance from the supporting element 12 to the underside of the plywood P is equal or approximately equal to the batt thickness. Consequently, the batt B1 is not compressed, or is compressed very little, by the holding article 10 so that the batt B1 is able to develop virtually its full insulating potential.

A second insulating batt B2 lies against the underside of the plywood P between the studs S2 and S3. The batt B2 is held in place in the same manner as the batt B1.

Considering still FIG. 2, one manner of operation of a holding article 10 in accordance with the invention will be described assuming that the batt B1 is being installed.

The batt B1 has a predetermined thickness as measured between two opposed major surfaces thereof, and the batt B1 is inserted between the studs S1 and S2 with one of the major surfaces facing the underside of the plywood P. This major surface is brought to rest against the underside of the plywood P. The other major surface faces downward towards the interior 1 of the building covered by the roof R.

The length of the supporting element 12 of a holding article 10 according to the invention is adjusted so that the distance between the U-shaped members 28,28' equals or approximates the distance between the studs S1,S2. With the batt B1 manually held between the studs S1,S2 and against the plywood P, the holding article 10 is positioned with the open ends of the U-shaped members 28,28' below and facing the respective studs S1,S2. The supporting element 12 runs below the downward facing major surface of the batt B1 from the stud S1 to the stud S2.

The U-shaped member 28 is now pushed onto the stud S1 so that the crosspiece 24 comes to lie against the bottom surface of the stud S1. Similarly, the U-shaped member 28t is pushed onto the stud S2 such that the crosspiece 24' comes to rest against the bottom surface of the stud S2. By virtue of these actions, the supporting element 12 comes into abutment with the downward facing major surface of the batt B1, and the batt B1 is now confined by the holding article 10. As indicated earlier, the holding article 10 is designed in such a manner that the batt B1 is compressed little if at all when confined by the holding article 10.

The distance between the gripping portion 36 and the anchoring portion 38 of the U-shaped member 28 is somewhat smaller than the width of the stud S1. The gripping portion 36 and the anchoring portion 38 are thus spread apart by the stud S1. The U-shaped member 28 possesses a certain amount of elasticity and is designed so that the spreading of the gripping portion 36 and the anchoring portion 38 occurs within the elastic range of the U-shaped member 28. Consequently, the gripping portion 36 and the anchoring portion 38 are resiliently urged towards one another and exert a grip on the stud S1. Furthermore, since the anchoring portion 38 tends to dig into the stud S1 due to the hook-like configuration of the anchoring portion 38, the anchoring portion 38 causes self-anchoring of the U-shaped member 28 to the stud S1.

Similarly to the U-shaped member 28, the distance between the gripping portion 36' and the anchoring portion 38' of the U-shaped member 28' is somewhat smaller than the width of the stud S2. The gripping portion 36' and the anchoring portion 38' are accordingly spread apart by the stud S2. The U-shaped member 28' again exhibits a certain amount of elasticity and is designed such that the spreading of the gripping portion 36' and the anchoring portion 38' takes place within the elastic range of the U-shaped member 28'. Hence, the gripping portion 36' and the anchoring portion 38' are elastically urged towards each other and generate a grip on the stud S2. Moreover, inasmuch as the anchoring portion 38' exhibits a tendency to dig into the stud S2 because of the hook-like shape of the anchoring portion 38', the anchoring portion 38' causes self-anchoring of the U-shaped member 28' to the stud S2.

Figure 3:
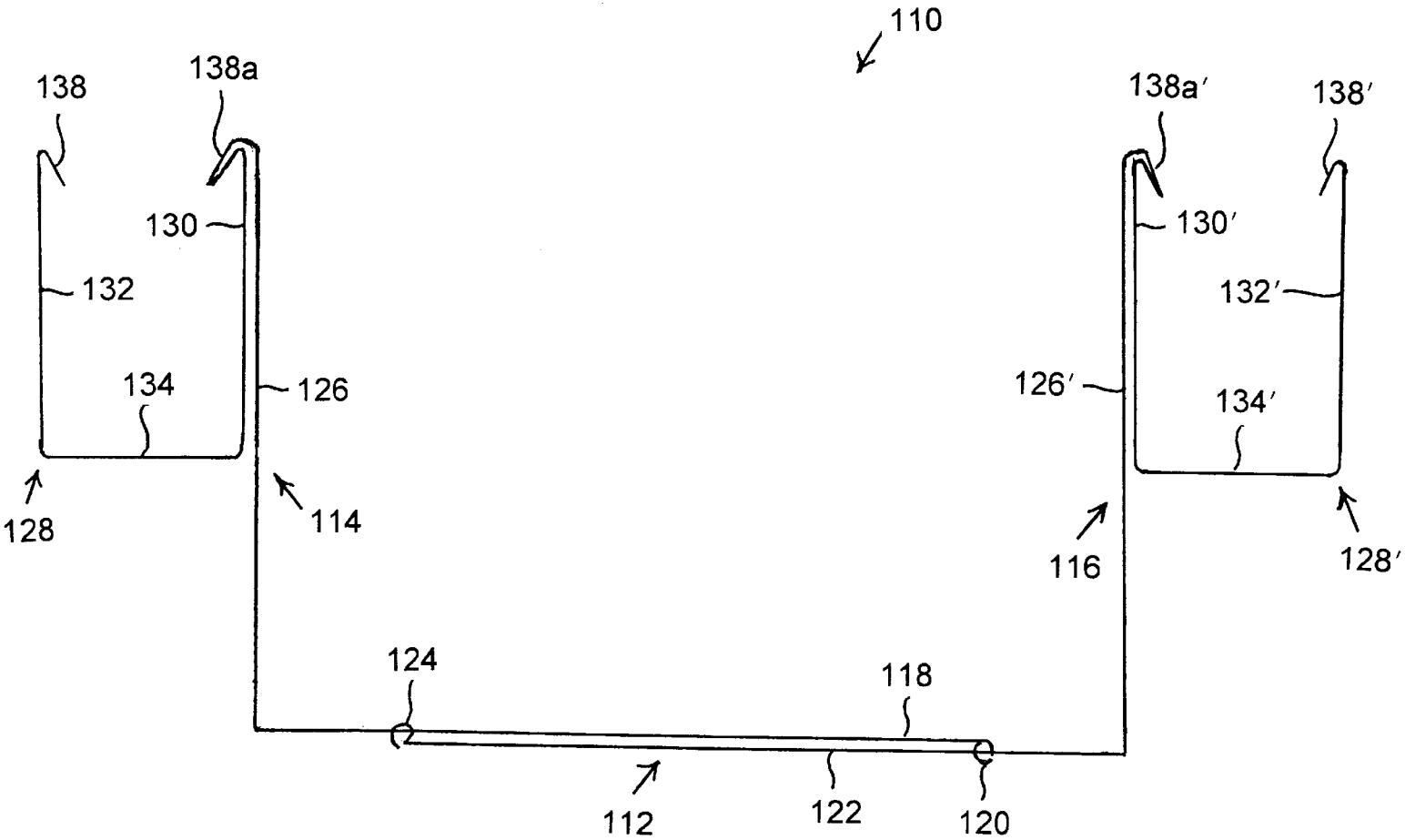
FIG. 3 is similar to FIG. 1 but illustrates another embodiment of an insulation holding article according to the invention.

Turning to FIG. 3, the same numerals as in FIG. 1, plus 100, identify corresponding parts.

The holding article 110 of FIG. 3 differs from the article 10 of FIG. 1 primarily in the design and placement of the U-shaped members 128 and 128'.

While the U-shaped member 28 of the article 10 is located on the same side of the anchoring arm 26 as the anchoring element 16, the U-shaped member 128 of the holding article 110 is situated on the side of the anchoring arm 126 remote from the anchoring element 116. Furthermore, the claw-like gripping portion 36 of the U-shaped member 28 is replaced by a hook-like anchoring portion 138*a*. Thus, in the holding article 10, the claw-like gripping portion 36 exists because both the end of the leg 30 and the end of the anchoring arm 26 remote from the supporting arm 18 are inclined upward and towards the leg 32 as considered in a direction away from the supporting arm 18. In the holding article 110, on the other hand, the end of the leg 130 and the end of the anchoring arm 126 remote from the supporting arm 118 are inclined downward and towards the leg 132 as considered in a direction towards the supporting arm 118. These two ends are joined to one another to produce the hook-like anchoring portion 138*a*.

The U-shaped member 128' of the holding article 110 is mirror-symmetrical to the U-shaped member 128 about a plane midway between the U-shaped members 128,128' and normal to the supporting element 112. Accordingly, the U-shaped member 128' will not be described.

Figure 4:
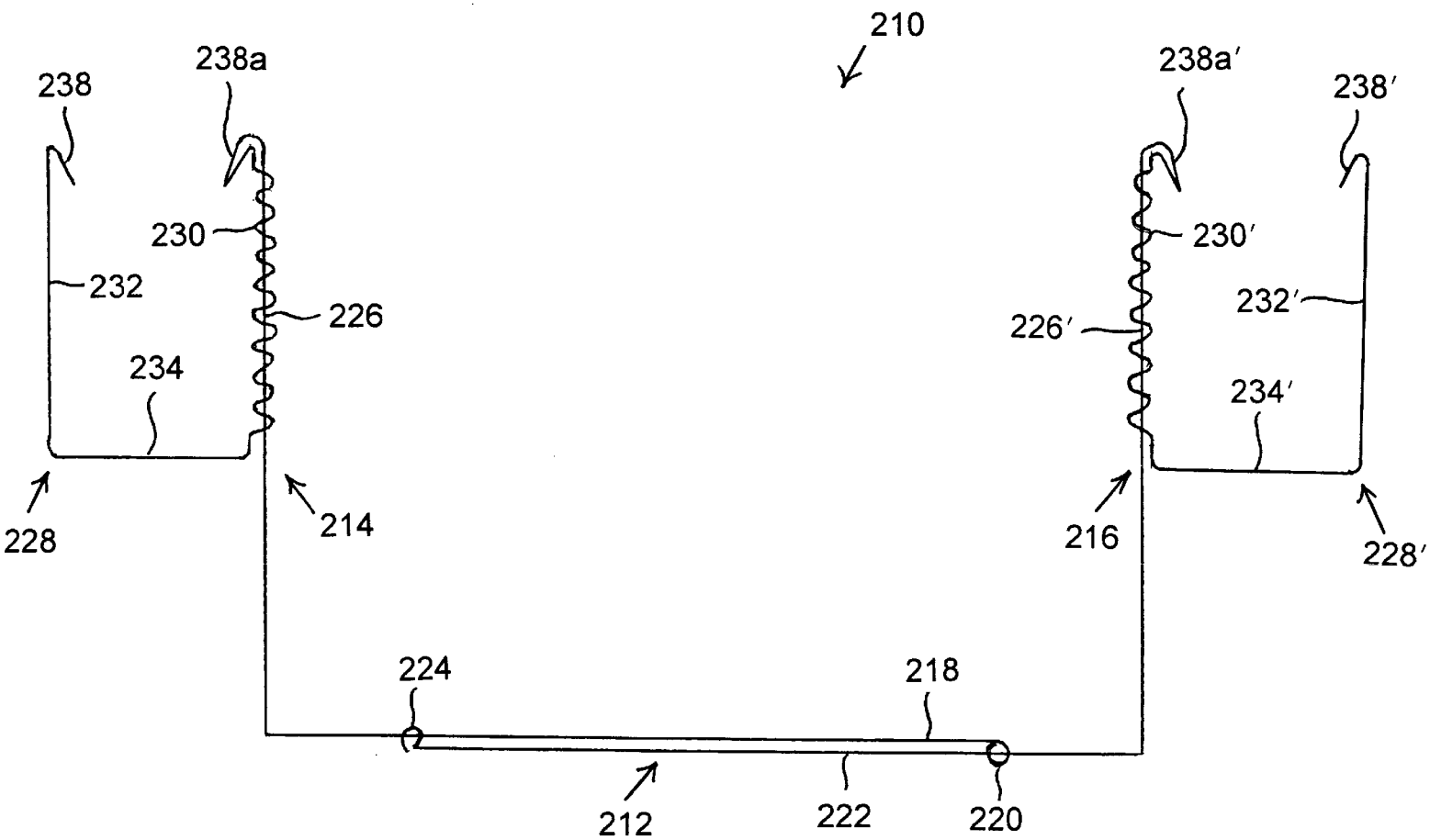
FIG. 4 is similar to FIG. 3 but shows an additional embodiment of an insulation holding article in accordance with the invention.

Considering FIG. 4, the same numerals as in FIG. 1, plus 200, denote corresponding parts.

The holding article 210 of FIG. 4 is similar to the holding article 110 of FIG. 3 but differs from the holding article 110 in that the leg 230 of the U-shaped member 228 is twisted around the anchoring arm 226 and the leg 230' of the U-shaped member 228' is twisted around the anchoring arm 226'. This allows the U-shaped members 228,228' to exert a stronger gripping action on studs or beams.

Figure 5:
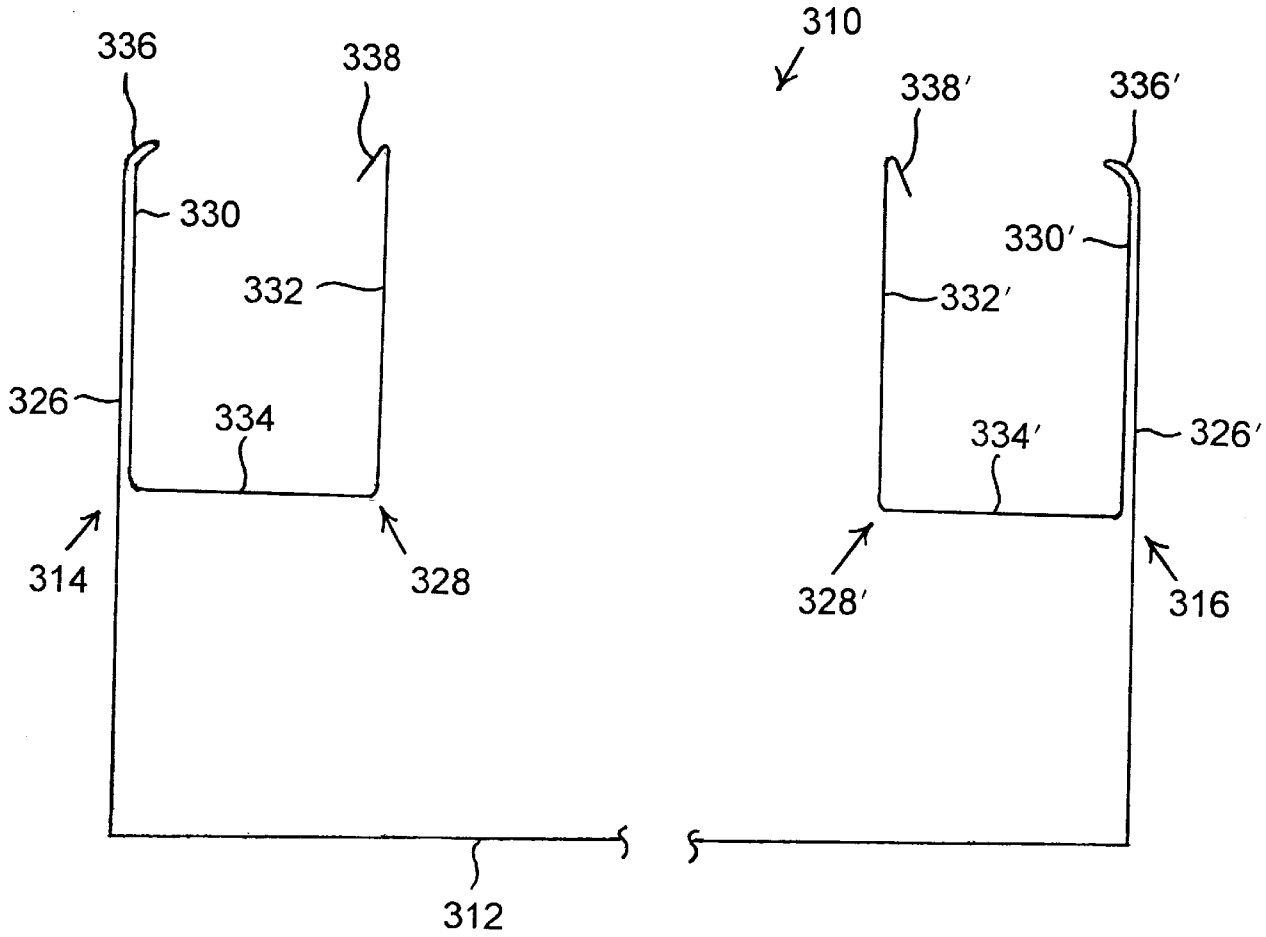
FIG. 5 is similar to FIG. 4 but illustrates a further embodiment of an insulation holding article according to the invention.

In FIG. 5, the same numerals as in FIG. 1, plus 300, identify corresponding parts.

The holding article 310 of FIG. 5 is the same as the holding article 10 of FIG. 1 except that the supporting element 312 of the holding article 310 is integral or of one piece. Hence, the length of the supporting element 312 of the holding article 310 is fixed instead of variable.

In as much as the holding articles 10,110,210,310 of the invention are self-anchoring, the holding articles 10,110, 210,310 can be anchored to a structure without the hammering required for the hangers of the prior art. This enables the holding articles 10,110,210,310 to be installed rapidly and conveniently.

Furthermore, by selecting the heights of the holding articles 10,110,210,310 appropriately, the holding articles 10,110,210,310 can support insulation with little or no compression of the latter. The insulation can then achieve its maximum, or virtually its maximum, insulating value.

In addition, the holding articles 10,110,210,310 can be readily released from a structure without damaging the holding articles 10,110,210,310 or the structure. This can be accomplished by spreading the legs of the U-shaped members 28,128,228,328 and retracting the holding articles 10,110,210,310.

The holding articles 10,110,210, which have variable lengths, further have the advantage of being adjustable to different distances between studs or beams.

Various modifications are possible within the meaning and range of equivalence of the appended claims. For instance, the invention can be practiced with metal as well as wood studs. Similarly, different embodiments of the invention can be combined.

I claim:

1. An article for holding insulation comprising:

a holder having a first wire element for supporting insulation, and self-anchoring, one-piece second and third wire elements for anchoring said holder to two beams of a structure to be insulated, each of said second and third elements defining an opening designed to receive a respective one of the beams, and each of said second and third elements including a generally U-shaped member which defines the respective opening and has a pair of spaced legs, each of said legs having an end portion which slopes towards the other leg of the respective U-shaped member so as to define a hook for anchoring said holder to a respective beam of the structure to be insulated.

2. The article of claim 1, wherein at least one of said legs is twisted to enhance gripping of a respective beam of the structure to be insulated by the respective U-shaped member.

3. The article of claim 1, wherein said first element comprises a first arm and said second element comprises a second arm, said first arm and said second arm cooperating to define a generally L-shaped part of said holder, and said second arm having an end which is spaced from said first arm by a predetermined distance, at least one of said hooks being held by said second arm at a distance from said first arm approximately equal to said predetermined distance.

4. The article of claim 1, wherein said first element has two ends and said second and third elements are located at respective ones of said ends.

5. The article of claim 4, wherein said first element is of one piece and has a fixed length.

6. The article of claim 4, wherein said first element comprises two sections which are relatively movable so as to vary the length of said first element.

7. The article of claim 6, wherein one of said sections has a guiding portion which no ably receives and guides the other of said sections.

8. A structure having an interior, said structure comprising:

a pair of beams at least in part bounding said interior:

insulation between said beams; and at least one holder for said insulation, said holder having a first wire element which supports said insulation, and self-anchoring, one-piece second and third wire elements which anchor said holder to said beams, each of said second and third elements defining an opening which receives a respective one of said beams, and each of said second and third elements including a generally U-shaped member which defines the respective opening and has a pair of spaced legs, each of said legs having an end portion which slopes towards the other leg of the respective U-shaped member so as to define a hook which anchors said holder to a respective one of said beams.

9. The structure of claim 8, wherein at least one of said legs is twisted to enhance gripping of a respective one of said beams by the respective U-shaped member.

10. The structure of claim 8, wherein said first element comprises a first arm and said second element comprises a second arm, said first arm and said second arm cooperating to define a generally L-shaped part of said holder, and said second arm having an end which is spaced from said first arm by a predetermined distance, at least one of said hooks being held by said second arm at a distance from said first arm approximately equal to said predetermined distance.

11. The structure of claim 8, herein said first element has two ends and said second and third elements are located at respective ones of said ends.

12. The structure of claim 11, wherein said first element is of one piece and has a fixed length.

13. An insulating method comprising the steps placing insulation between two beams of a structure; and confining said insulation between said beams using a holder, said holder comprising a pair of one-piece wire elements each of which defines an opening, and the confining step including inserting one of said beans in each of said openings, the confining step further including self-anchoring of each of said elements to a respective one of said beans, and each of said elements comprising two hooks which anchor the respective element to the respective beam.

14. The structure of claim 13, wherein one of said sections has a guiding portion which movably receives and guides the other of said sections.

15. The structure of claim 11, wherein said first element comprises two sections which are relatively movable so as to vary the length of said first element.

16. The method of claim 13, further comprising the step of adjusting the length of said holder prior to the confining step.

17. An article for holding insulation comprising:

a single-piece wire of integral construction having an elongated middle portion for supporting insulation and a pair of one-piece self-anchoring end portions for anchoring said article to two beams of a structure to be insulated;

wherein each of said end portions comprises a generally U-shaped member for receiving one of said two beams, each of said U-shaped members including a pair of legs and a crosspiece connecting the legs to one another, and one of the legs of at least one of said U-shaped members being twisted to enhance gripping of the beam by a tip of the respective U-shaped member, each of said legs having an end portion which slopes towards the other leg of the respective U-shaped member so as to define a hook for anchoring said article to a respective beam of the structure to be insulated.

* * * * *

UNITED STATES PATENT AND TRADEMARK OFFICE

CERTIFICATE OF CORRECTION

PATENT NO. : 6,487,825 B1
DATED : December 3, 2002
INVENTOR(S) : Francisco J. Sillik It is certified that error appears in the above-identified patent and that said Letters Patent is hereby corrected as shown below:

Column 7,
Line 2, replace the words “no ably” with -- movably --.

Column 8,
Line 1, add the word -- of -- after “steps”

Signed and Sealed this

First Day of April, 2003

JAMES E. ROGAN
*Director of the United States Patent and Trademark Office*